US010174399B2

(12) United States Patent
Okonogi et al.

(10) Patent No.: US 10,174,399 B2
(45) Date of Patent: Jan. 8, 2019

(54) HIGH CARBON STEEL WIRE ROD AND METHOD FOR MANUFACTURING SAME

(71) Applicant: NIPPON STEEL & SUMITOMO METAL CORPORATION, Tokyo (JP)

(72) Inventors: Makoto Okonogi, Chiba (JP); Daisuke Hirakami, Kisarazu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 306 days.

(21) Appl. No.: 14/899,969

(22) PCT Filed: Jun. 23, 2014

(86) PCT No.: PCT/JP2014/066532

§ 371 (c)(1),
(2) Date: Dec. 18, 2015

(87) PCT Pub. No.: WO2014/208492

PCT Pub. Date: Dec. 31, 2014

(65) Prior Publication Data

US 2016/0145712 A1 May 26, 2016

(30) Foreign Application Priority Data

Jun. 24, 2013 (JP) ..... 2013-131959
Jun. 24, 2013 (JP) ..... 2013-131961

(51) Int. Cl.
*C21D 9/52* (2006.01)
*C21D 7/13* (2006.01)
(Continued)

(52) U.S. Cl.
CPC ..... *C21D 9/525* (2013.01); *C21D 6/004* (2013.01); *C21D 6/005* (2013.01); *C21D 6/008* (2013.01);
(Continued)

(58) Field of Classification Search
CPC .. C21D 2211/009; C21D 6/004; C21D 6/005; C21D 6/008; C21D 7/13; C21D 8/06;
(Continued)

(56) References Cited

U.S. PATENT DOCUMENTS 4,123,296 A * 10/1978 Yamakoshi ..... C21D 8/06 148/333
2006/0048864 A1 3/2006 Nagao et al.
(Continued)

FOREIGN PATENT DOCUMENTS

CN 1745187 A 3/2006
CN 1840729 A 10/2006
(Continued)

OTHER PUBLICATIONS

Extended European Search Report, dated Feb. 7, 2017, for counterpart European Application No. 14818358.5.
(Continued)

*Primary Examiner* — Jenny R Wu
(74) *Attorney, Agent, or Firm* — Birch, Stewart, Kolasch & Birch, LLP

(57) ABSTRACT

A steel wire rod includes required amounts of chemical components and a remainder including Fe and impurities; in which the area ratio of pearlite in a cross section perpendicular to a longitudinal direction is 95% or more and a remainder includes a non-pearlite structure which includes one or more of a bainite, a degenerate pearlite, a proeutectoid ferrite and a proeutectoid cementite; the average block size of the pearlite is 15 μm to 35 μm and the area ratio of the pearlite having a block size of 50 μm or more is 20% or less; and the area ratio of a region where a lamellar spacing of the pearlite is 150 nm or less is 20% or less in a region within a depth from a surface of the steel wire rod of 1 mm or less.

7 Claims, 1 Drawing Sheet

(51) Int. Cl.

| | |
|---|---|
| ***C21D 6/00*** | (2006.01) |
| ***C22C 38/18*** | (2006.01) |
| ***C22C 38/00*** | (2006.01) |
| ***C22C 38/12*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C21D 8/06*** | (2006.01) |
| ***C22C 38/16*** | (2006.01) |
| ***C22C 38/54*** | (2006.01) |

(52) U.S. Cl.
CPC ..... *C21D 7/13* (2013.01); *C21D 8/065* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/54* (2013.01); *C21D 8/06* (2013.01); *C21D 2211/009* (2013.01)

(58) Field of Classification Search
CPC ..... C21D 8/065; C21D 9/525; C22C 38/00; C22C 38/001; C22C 38/002; C22C 38/02; C22C 38/04; C22C 38/06; C22C 38/08; C22C 38/12; C22C 38/16; C22C 38/18; C22C 38/54
See application file for complete search history.

(56) References Cited

U.S. PATENT DOCUMENTS

| | | | | |
|---|---|---|---|---|
| 2010/0212786 | A1 | 8/2010 | Yamasaki et al. | |
| 2011/0229718 | A1 | 9/2011 | Nishida et al. | |
| 2014/0000767 | A1 * | 1/2014 | Yamasaki ..... | C21D 8/08 148/546 |

FOREIGN PATENT DOCUMENTS

| | | | | |
|---|---|---|---|---|
| CN | 102216482 | A | 10/2011 | |
| EP | 2034036 | A2 | 3/2009 | |
| JP | 5-296448 | A | 11/1993 | |
| JP | 2003-82434 | A | 3/2003 | |
| JP | 2004-137597 | A | 5/2004 | |
| JP | 2005-206853 | A | 8/2005 | |
| JP | 2006-200039 | A | 8/2006 | |
| JP | 2007-131944 | A | 5/2007 | |
| JP | 2008-7856 | A | 1/2008 | |
| JP | 2011-219829 | A | 11/2011 | |
| JP | 2012-126954 | A | 7/2012 | |
| JP | 2012-126955 | A | 7/2012 | |
| WO | WO-2012124679 | A1 * | 9/2012 | ..... C21D 8/08 |

OTHER PUBLICATIONS

Chinese Office Action and Search Report, dated Aug. 10, 2016, for counterpart Chinese Application No. 201480035272.3, as well as an English translation of the Chinese Search Report.
International Search Report, issued in PCT/JP2014/066532, dated Sep. 2, 2014.
Written Opinion of the International Searching Authority, issued in PCT/JP2014/066532, dated Sep. 2, 2014.

* cited by examiner

HIGH CARBON STEEL WIRE ROD AND METHOD FOR MANUFACTURING SAME

TECHNICAL FIELD OF THE INVENTION

The present invention relates to a high carbon steel wire rod having an excellent drawability, which is suitable for a steel cord used as reinforcement material of a radial tire for vehicle or a belt and a hose for various industries, furthermore, preferable for a sawing wire, and a method for manufacturing the same.

Priority is claimed on Japanese Patent Application No. 2013-131959, filed on Jun. 24, 2013 and Japanese Patent Application No. 2013-131961, filed on Jun. 24, 2013, the contents of which are incorporated herein by reference.

RELATED ART

Steel wires for steel cords used as reinforcement material of a radial tire for vehicle or a belt and a hose for various industries or steel wires for sawing wire are generally made from wire rods having a wire diameter to which a controlled cooling is performed after hot-rolling, that is, a diameter of 4 mm to 6 mm. A primary wire drawing is performed to the wire rods so as to obtain steel wires having a diameter of 3 mm to 4 mm. Next, an intermediate patenting treatment is performed to the steel wires and a secondary wire drawing is performed to the steel wires so as to obtain steel wires having a diameter of 1 mm to 2 mm. After the secondary wire drawing, a final patenting treatment is performed to the steel wires and a brass-plating is performed. Then, a final wet wire drawing is performed so as to obtain steel wires having a diameter of 0.15 mm to 0.40 mm. A plurality of the obtained high carbon steel wires are twisted together to make steel stranded wires. Then, steel cords are manufactured by the obtained steel stranded wires.

In recent years, from the view point of reducing a manufacturing cost, there are many cases where the above intermediate patenting treatment is omitted, a direct wire drawing is performed to the control-cooled wire rod and the wire rod having a diameter of 1 mm to 2 mm after the final patenting treatment is obtained. Therefore, the direct drawing properties, that is, the rod drawability from the wire rods is required to the controlled-cooled wire rods, and there is a great need for the wire rods having excellent ductility and drawability.

For example, as disclosed in Patent Documents 1 to 5, many methods for improving the drawability of wire rods to which patenting treatment is performed have been proposed.

For example, a high carbon wire rod having a pearlite of 95% or more by area ratio, the average nodule diameter of the pearlite of 30 μm or less, and the average lamellar spacing of 100 nm or more is disclosed in Patent Document 1. In addition, a high strength wire rod to which B is added is disclosed in Patent Document 4.

However, a disconnection due to accelerating drawing speed, or a disconnection caused by increasing of wire drawing degree cannot be improved, or an effect for improving the drawability which is enough to affect the manufacturing cost during drawing cannot be obtained even if these prior arts are disclosed.

PRIOR ART DOCUMENT

Patent Document

[Patent Document 1] Japanese Unexamined Patent Application, First Publication No. 2003-082434

[Patent Document 2] Japanese Unexamined Patent Application, First Publication No. 2005-206853

[Patent Document 3] Japanese Unexamined Patent Application, First Publication No. 2006-200039

[Patent Document 4] Japanese Unexamined Patent Application, First Publication No. 2007-131944

[Patent Document 5] Japanese Unexamined Patent Application, First Publication No. 2012-126954

DISCLOSURE OF THE INVENTION

Problems to be Solved by the Invention

The present invention has been made in consideration of the above-described circumstances, and an object of the present invention is to inexpensively provide a high carbon steel wire rod having an excellent drawability which is suitable for a steel cord and a sawing wire and a method for manufacturing the same under high productivity with good yield.

Means for Solving the Problem

In order to improve the drawability of the high carbon steel wire rod, reducing tensile strength of the wire rod and improving the ductility of the wire rod due to refining pearlite block in pearlite are effective.

Generally, the tensile strength and the ductility of the high carbon steel wire rod having a structure essentially including pearlite are dependent on a pearlite transformation temperature.

Pearlite is a lamellar structure in which cementite and ferrite are arranged in layers and a lamellar spacing corresponding to a layer distance between cementite and ferrite has a great influence on the tensile strength. In addition, the lamellar spacing of pearlite is determined by the transformation temperature at which austenite is transformed to pearlite. When the pearlite transformation temperature is high, the lamellar spacing of pearlite is widened, and thus, the tensile strength of the wire rod becomes lower. On the other hand, when the pearlite transformation temperature is low, the lamellar spacing of pearlite is small, and thus, the tensile strength of the wire rod is improved.

In addition, the ductility of the wire rod is influenced by grain size of the pearlite block (pearlite block size). Furthermore, the pearlite block size is influenced by the pearlite transformation temperature as with lamellar spacing. For example, when the pearlite transformation temperature is high, the pearlite block size is large, and thus, the ductility of the wire rod is deteriorated. On the other hand, when the pearlite transformation temperature is low, the pearlite block size is small, and thus, the ductility of the wire rod is improved.

That is, when the pearlite transformation temperature is high, the tensile strength and the ductility of the wire rod are deteriorated. On the other hand, when the pearlite transformation temperature is low, the tensile strength and the ductility of the wire rod are improved. In order to improve the drawability of the wire rod, improving the ductility of the wire rod due to lowering the tensile strength of the wire rod is effective. However, as described above, even if the transformation temperature is high or low, it has been difficult to obtain both a sufficient tensile strength and a sufficient ductility of the wire rod.

The present inventors investigated in detail that the influences on the drawability due to the structure and the mechanical properties of the wire rods in order to solve the above problem. As a result, the present inventors found the following findings.

Hereinafter, a region within a range of 1 mm or less in a depth from a surface of the wire rod is set to the first surface portion, and a region within a range of 30 μm or less in a depth from a surface of the wire rod is set to the second surface portion.

(a) In order to reduce the frequency of disconnection, setting the structure of the first surface portion and second surface portion to be a structure essentially including pearlite is effective. When a soft structure such as proeutectoid ferrite, degenerate pearlite and bainite is included in the second surface portion, deformation is concentrated and becomes a starting point where a cracking is generated during wire drawing. Accordingly, limiting these soft structures is effective for improving drawability.

(b) In order to reduce the frequency of disconnection, setting an average block size of pearlite block in the cross section of the wire rod to be 15 μm to 35 μm is effective. In addition, when the area ratio of coarse pearlite block having a block size of more than 50 μm is more than 20%, the frequency of disconnection becomes high.

(c) Setting the lamellar spacing of pearlite in the first surface portion to be widened is effective for improving the wire rod. In addition, when the area ratio of a region where the lamellar spacing is 150 nm or less is 20% or less in the first surface portion, the frequency of disconnection can be reduced.

(d) Setting the tensile strength of the wire rod to be 760×Ceq.+325 MPa or less is effective for improving the drawability of the wire rod.

(e) Reducing a dispersion of the tensile strength of the wire rod is effective for improving the drawability of the wire rod. Particularly, when the standard deviation of the tensile strength of the wire rod is 20 MPa or less, the frequency of disconnection can deteriorate.

(f) Not softening the hardness of the first surface portion and the second surface portion of the wire rod is effective for reducing the frequency of disconnection. When the first surface portion and the second surface portion is softened due to decarburization or reduction of carbon, the frequency of generation of the disconnection becomes high during strong deformation such as a working strain of more than 3.5 at wire drawing is given to the wire rod. In particular, when the Vickers hardness at the second surface portion is lower than HV 280, the frequency of disconnection increases.

The present invention has been completed based on the above findings and the summary of the present invention is as described below.

(1) According to an aspect of the present invention, a high carbon steel wire rod includes as a chemical component, by mass %: C: 0.60% to 1.20%, Si: 0.10% to 1.5%, Mn: 0.10% to 1.0%, P: 0.001% to 0.012%, S: 0.001% to 0.010%, Al: 0.0001% to 0.010% and N: 0.0010% to 0.0050%, and a remainder including Fe and impurities; in which the area ratio of pearlite is 95% or more and a remainder is a non-pearlite structure which includes one or more of a bainite, a degenerate pearlite, a proeutectoid ferrite and a proeutectoid cementite in a cross section perpendicular to a longitudinal direction; in which the average block size of the pearlite is 15 μm to 35 μm and the area ratio of the pearlite having a block size of 50 μm or more is 20% or less; in which the area ratio of a region where a lamellar spacing of the pearlite is 150 nm or less is 20% or less in a region within a depth from a surface of the high carbon steel wire rod of 1 mm or less; when C [%], Si [%] and Mn [%] represent the amount of C, the amount of Si and the amount of Mn respectively in an equation A and a Ceq. is calculated by the equation A, the tensile strength of the high carbon steel wire rod is 760×Ceq.+325 MPa or less and the standard deviation of the tensile strength is 20 MPa or less.

$$Ceq.=C\,[\%]+Si\,[\%]/24+Mn\,[\%]/6 \qquad \text{Equation A.}$$

(2) In the high carbon steel wire rod according to (1), the high carbon steel wire rod may include, as a chemical component, by mass %: C: 0.70% to 1.10%; in which the area ratio of the pearlite in a region within a depth from the surface of the high carbon steel wire rod of 30 μm or less may be 90% or more and a remainder may be the non-pearlite structure which includes one or more of the bainite, the degenerate pearlite and the proeutectoid cementite; and the average Vickers hardness at a position of 30 μm in the depth from the surface of the high carbon steel wire rod may be HV 280 to HV 330.

(3) In the high carbon steel wire rod according to (1) or (2), the high carbon steel wire rod may include, as a chemical component, by mass %: one or more kinds selected from the group consisting of S: 0.0001% to 0.0015%; Cr: 0.10% to 0.50%; Ni: 0.10% to 0.50%; V: 0.05% to 0.50%; Cu: 0.10% to 0.20%; Mo: 0.10% to 0.20% and Nb: 0.05% to 0.10%.

(4) According to another aspect of the invention, there is provided a method for manufacturing a high carbon steel wire rod, the method includes: heating a billet to 950° C. to 1130° C., in which the billet includes, as a chemical component, by mass %: C: 0.60% to 1.20%, Si: 0.1% to 1.5%, Mn: 0.1% to 1.0%, P: 0.001% to 0.012%, S: 0.001% to 0.010%, Al: 0.0001% to 0.010% and N: 0.0010% to 0.0050%, and a remainder including Fe and impurities, hot-rolling the billet so as to obtain a wire rod after heating, coiling the wire rod at 700° C. to 900° C., primary cooling the wire rod to 630° C. to 660° C. at a primary cooling rate of 15° C./sec to 40° C./sec, holding the wire rod at 660° C. to 630° C. for 15 seconds to 70 seconds, and secondary cooling the wire rod to 25° C. to 300° C. at a secondary cooling rate of 5° C./sec to 30° C./sec.

(5) In the method for manufacturing a high carbon steel wire rod according to (4), in which a difference of the primary cooling rate between at a position where the primary cooling rate is maximum in a steel wire ring and at a position where the primary cooling rate is minimum in the steel wire ring may be set to 10° C./sec or less in the primary cooling.

Effects of the Invention

According to the respective aspects (1) to (5) of the present invention described above, it is possible to inexpensively provide a high carbon steel wire rod having an excellent drawability.

EMBODIMENTS OF THE INVENTION

Figure 1:
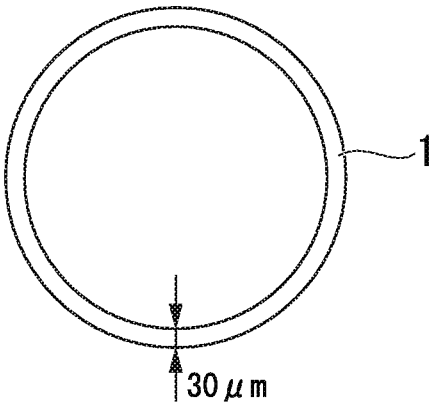
FIG. 1 is a schematic view showing a second surface portion in a cross section perpendicular to a longitudinal direction of a high carbon steel wire rod according to an embodiment of the present invention.
Figure 2:
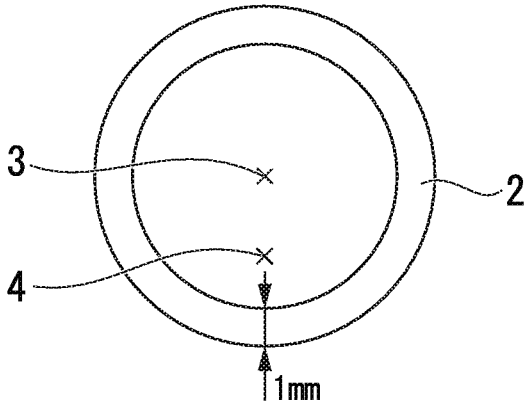
FIG. 2 is a schematic view showing a first surface portion, a ½D portion and a ¼D portion in a cross section perpendicular to a longitudinal direction of a high carbon steel wire rod according to an embodiment of the present invention.

Firstly, the reason for limiting the chemical components of a high carbon steel wire rod according to an embodiment of the present invention will be described. Here, "%" in the following description represents "mass %".

C: 0.60% to 1.20%

C is an essential element to improve strength of a wire rod.

When an amount of C is lower than 0.60%, it is difficult to stably provide strength to a final product and it is difficult to obtain uniform pearlite due to promotion for precipitation of proeutectoid ferrite at an austenite grain boundary.

Therefore, the lower limit of the amount of C is set to 0.60%. To obtain more uniform pearlite, the amount of C is preferably set to 0.70% or more.

On the other hand, when the amount of C is more than 1.20%, a disconnection is easy to occur during drawing because the proeutectoid cementite having mesh structure is generated at the austenite grain boundary, and toughness and ductility of a high carbon steel wire are remarkably deteriorated after the final wire drawing.

Therefore, the upper limit of the amount of C is set to 1.20%. To surely prevent the deterioration in the toughness and ductility of the wire rod, the amount of C is preferably set to 1.10% or less.

Si: 0.10% to 1.5%

Si is an essential element to improve strength of a wire rod.

Furthermore, Si is a useful element as a deoxidizer, and Si is an essential element when a wire rod not including Al is a target.

When the amount of Si is lower than 0.10%, a deoxidation action is too small. Therefore, the lower limit of the amount of Si is set to 0.10%.

On the other hand, when the amount of Si is more than 1.5%, precipitation of proeutectoid ferrite is promoted in hypereutectoid steel. Furthermore, the working-limit deteriorates during wire drawing. In addition, it is difficult to perform a wire drawing by mechanical descaling, that is, MD. Therefore, the upper limit of the amount of Si is set to 1.5%.

Mn: 0.10% to 1.0%

Mn is an essential element to act as a deoxidizer, similar to Si.

In addition, Mn has an effect for improving hardenability and the strength of wire rod can be improved. Furthermore, Mn has an effect of preventing a hot embrittlement by fixing S in steel as MnS.

When the amount of Mn is lower than 0.10%, it is difficult to obtain the above effect. Therefore, the lower limit of the amount of Mn is set to 0.10%.

On the other hand, Mn is an element which tends to segregate. When the amount of Mn is more than 1.0%, Mn segregates at a center of wire rod and martensite or/and bainite is generated in the segregated part. Thus, the drawability is deteriorated. Therefore, the upper limit of the amount of Mn is set to 1.0%.

The total amount of Si and Mn in the wire rod is preferably set to 0.61% or more.

When the total amount of Si and Mn is lower than 0.61%, there is a case where the above deoxidation effect or the effect for preventing the hot embrittlement can be obtained. In addition, in order to effectively obtain the effect as the deoxidizer, the total amount of Si and Mn is preferably set to 0.64% or more, and is more preferably set to 0.67% or more.

On the other hand, when the total amount of Si and Mn is more than 2.3%, there is a case where Mn or/and Si is remarkably segregated at the center of steel wire. Therefore, the total amount of Si and Mn is preferably set to 2.3% or less. To obtain more suitable manner for wire drawing, the total amount of Si and Mn is more preferably set to 2.0% or less, and still more preferably set to 1.7% or less.

P: 0.001% to 0.012%

P is an element which deteriorates the toughness of the wire rod by segregating at a grain boundary.

When the amount of P is more than 0.012%, the ductility of the wire rod is remarkably deteriorated. Therefore, the upper limit of the amount of P is set to 0.012%. On the other hand, the lower limit of the amount of P is set to 0.001% in consideration of the current refining techniques and the manufacturing cost.

S: 0.001% to 0.010%

S is an element which prevents the hot embrittlement by forming a sulfide MnS with Mn.

When the amount of S is more than 0.010%, the ductility of the wire rod is remarkably deteriorated. Therefore, the upper limit of the amount of S is set to 0.010%. On the other hand, the lower limit of the amount of S is set to 0.001% in consideration of the current refining techniques and the manufacturing cost.

Al: 0.0001% to 0.010%

Al is an element which deteriorates the ductility of the wire rod by forming an alumina-based nonmetallic inclusion which is hard and not deformed. Therefore, the upper limit of the amount of Al is set to 0.010%. On the other hand, the lower limit of the amount of Al is set to 0.001% in consideration of the current refining techniques and the manufacturing cost.

N: 0.0010% to 0.0050%

N is an element which deteriorates the ductility of the wire rod by promoting an aging as solid-soluted N in the wire drawing. Therefore, the upper limit of the amount of N is set to 0.0050%. On the other hand, the lower limit of the amount of N is set to 0.0010% in consideration of the current refining techniques and the manufacturing cost.

The total amount of Al and N in the wire rod is preferably set to 0.007% or less. When the amount of Al and N is more than 0.007%, there is a case where the ductility of the wire rod is deteriorated by generating a metallic inclusion. On the other hand, the lower limit of the total amount of Al and N is preferably set to 0.003% when considering the current refining techniques and the manufacturing cost.

The above-described elements are basic components of the high carbon steel wire rod according to the embodiment of the present invention, and a remainder other than the above-described elements includes Fe and unavoidable impurities. However, in addition to these basic components, for the purpose of improving the mechanical properties of the high carbon steel wire rod such as the strength, toughness or ductility, one or more kinds selected from the group consisting of B, Cr, Ni, V, Cu, Mo and Nb may be added to the high carbon steel wire rod according to the embodiment of the present invention, instead of a part of Fe in the remainder.

B: 0.0001% to 0.0015%

Bi is an element which segregates at the grain boundary and improves the drawability by suppressing the generation of the non-pearlite structure such as ferrite, degenerate pearlite or bainite, when B is in the austenite as solid-soluted B. Therefore, an amount of 13 is preferably set to 0.0001% or more. On the other hand, when the amount of B is more than 0.0015%, a coarse boron carbide such as $Fe_{23}(CB)_6$ is generated, and the drawability of the wire rod is deteriorated. Therefore, the upper limit of the amount of B is preferably set to 0.0015%.

Cr: 0.10% to 0.50%

Cr is an effective element which narrows the lamellar spacing of pearlite and improves the strength, drawability or the like of the wire rod. To effectively exhibit the above actions, the amount of Cr is preferably set to 0.10% or more. On the other hand, when the amount of Cr is more than 0.50%, the time until the pearlite transformation is completed becomes longer, and there is a concern where a supercooled structure such as martensite or bainite is generated. Furthermore, mechanical descaling property is deteriorated. Therefore, the upper limit of the amount of Cr is preferably set to 0.50%.

Ni: 0.10% to 0.50%

Ni is an element which is not very effective for improving the strength of the wire rod, but improves the toughness of the high carbon steel wire rod. To effectively exhibit the above actions, an amount of Ni is preferably set to 0.10% or more. On the other hand, when the amount of Ni is more than 0.50%, the time until the pearlite transformation is completed becomes longer. Therefore, the upper limit of the amount of Ni is preferably set to 0.50%.

V: 0.05% to 0.50%

V is an effective element which forms a fine carbonitride in the ferrite and improves the ductility of the wire rod by preventing coarsening an austenite grain during heating. In addition, V has an effect which contributes an improvement of the strength of the wire rod after the hot-rolling. To effectively exhibit the above actions, an amount of V is preferably set to 0.05% or more. On the other hand, when the amount of V is more than 0.50%, the amount of formed carbonitride is excessively increased and a particle size of the carbonitride becomes larger. Therefore, the upper limit of the amount of V is preferably set to 0.50%.

Cu: 0.10% to 0.20%

Cu has an effect which improves corrosion resistance of the high carbon steel wire rod. To effectively exhibit the above actions, an amount of Cu is preferably set to 0.10% or more. On the other hand, when the amount of Cu is more than 0.20%, CuS is segregated in the grain boundary by reacting Cu with S and flaws are generated in the steel ingot or wire rod during manufacturing process of the wire rod. To effectively prevent the above negative influence, the upper limit of the amount of Cu is preferably set to 0.20%.

Mo: 0.10% to 0.20%

Mo has an effect which improves corrosion resistance of the high carbon steel wire rod. To effectively exhibit the above actions, the amount of Mo is preferably set to 0.10% or more. On the other hand, when the amount of Mo is more than 0.20%, the time until the pearlite transformation is completed becomes longer. Therefore, the upper limit of the amount of Mo is preferably set to 0.20%.

Nb: 0.05% to 0.10%

Nb has an effect which improves corrosion resistance of the high carbon steel wire rod. To effectively exhibit the above actions, the amount of Nb is preferably set to 0.05% or more. On the other hand, when the amount of Nb is more than 0.10%, the time until the pearlite transformation is completed becomes longer. Therefore, the upper limit of the amount of Nb is preferably set to 0.10%.

Next, structures and mechanical properties of the high carbon steel wire rod according to an embodiment of the present invention will be described.

In the high carbon steel wire rod having a structure essentially including pearlite according to an embodiment of the present invention, when non-pearlite structure such as a proeutectoid ferrite, a bainite, a degenerate pearlite and a proeutectoid cementite in a cross section perpendicular to a longitudinal direction of the wire rod is more than 5% by an area ratio, the drawability is deteriorated because crack is easy to occur during wire drawing. Therefore, the area ratio of the pearlite is set to 95% or more.

The area ratio of non-pearlite structure in the high carbon steel wire rod according to an embodiment of the present invention means the following. When D represents a wire diameter, the average area ratio of the non-pearlite structure can be obtained by averaging each area ratios of the non-pearlite structures in the first surface portion, in the ½D portion and in ¼D portion. On the other hand, the average area ratio of the pearlite structure can be obtained by averaging each area ratios of the pearlite structure in the first surface portion, in the ½D portion and in the ¼D portion.

The area ratio of non-pearlite structure may be measured by as following methods. After a cross section perpendicular to a longitudinal direction of the wire rod, that is, C cross section is embedded in resin, polishing with alumina is performed to the C cross section and the C cross section is subjected to corrosion with picral solution. Then, the obtained C cross section can be observed with a SEM. Hereinafter, a region within a range of 1 mm or less in a depth from a surface of the wire rod is set to the first surface portion. When D represents a wire diameter, observations with SEM are performed at the first surface portion, at the ½D portion and at ¼D portion. Then, photographs are taken on the 8 positions with 45° intervals at a magnification of 3000 times in each observation area having a square of 50 μm×40 μm. In addition, the area ratio of the non-pearlite structure such as the degenerate pearlite where cementite is dispersed in granular, the bainite where cementite formed in planar shape is dispersed in a lamellar spacing which is 3 times coarser than the surroundings, the proeutectoid ferrite precipitated at prior austenite grain boundary and the proeutectoid cementite is measured by an image analysis, respectively. Then, the measured area ratio of each non-pearlite structure is summed up and the obtained value is set to the area ratio of the non-pearlite structure. In addition, the area ratio of the pearlite can be obtained by subtracting the obtained area ratio of the non-pearlite structure from 100%.

In the high carbon steel wire rod according to an embodiment of the present invention, a region within a range of 30 μm or less in a depth from a surface of the wire rod is set to the second surface portion. When non-pearlite structure such as a proeutectoid ferrite, a bainite and a degenerate pearlite in the second surface portion is more than 10% by area ratio, strength at surface of the wire rod becomes ununiform and crack is easy to occur in the surface during wire drawing, and thus, there is a case where the drawability is deteriorated. Therefore, the area ratio of pearlite in the second surface portion is preferably set to 90% or more. A remainder other than the pearlite is preferably set to non-pearlite structure including one or more of bainite, degenerate pearlite and proeutectoid cementite. More preferably, the remainder other than the pearlite is set to the non-pearlite structure consisting of one or more of bainite, degenerate pearlite and proeutectoid cementite.

To measure an area ratio of non-pearlite structure in the second surface portion, after C cross section of the wire rod is embedded in resin, polishing with alumina is performed to the C cross section and the C cross section is subjected to corrosion with picral solution, and then, the obtained C cross section can be observed with a SEM. In the observation with SEM, photographs are taken on the 8 positions with central angle 45° intervals of the C cross section at a magnification of 2000 times in the second surface portion. In addition, the area ratio of the non-pearlite structure such as the degenerate pearlite where cementite is dispersed in granular, the bainite where cementite formed in planar shape is dispersed in a lamellar spacing which is 3 times coarser than the surroundings and the proeutectoid ferrite precipitated at prior austenite grain boundary is measured by an image analysis, respectively. Then, the measured area ratio of each non-pearlite structure is summed up and the obtained value is set to the area ratio of the non-pearlite structure. In addition, the area ratio of the pearlite can be obtained by subtracting the obtained area ratio of the non-pearlite structure from 100%.

A pearlite block is substantially spherical. The pearlite block means a region where it is regarded that a crystal orientation of ferrite is oriented in the same direction and when an average block size is more refined, ductility of wire rod is more improved. When the average block size is greater than 35 μm, the ductility of wire rod is deteriorated and disconnection is easy to occur during wire drawing. On the other hand, when the average block size is smaller than 15 μm, tensile strength is raised and deformation resistance is increased during wire drawing, and thus, the manufacturing cost becomes higher. In addition, when the area ratio of the pearlite having the block size of 50 μm or more is more than 20%, the frequency of disconnection during wire drawing is increased. Hereinafter, the block size is a diameter of circle having an area equivalent to an area occupied by the pearlite block.

The pearlite block size can be obtained by as following methods. After C cross section is embedded in resin, cutting and polishing is performed to the C cross section. Then, a region having a square size of 800 μm×800 μm in the center of the C cross section is analyzed with EBSD. In the region, an interface having an orientation difference of 9° or more is set to an interface of pearlite block. Then, a region surrounded by the interfaces is analyzed as one pearlite block. A mean value is obtained by averaging the analyzed equivalent circle diameters and the mean value is set to the average block size of pearlite.

When an area ratio of a region where a lamellar spacing of the pearlite is 150 nm or less is more than 20% in the first surface portion, disconnection is easy to occur during wire drawing. The lamellar spacing of the pearlite can be obtained by as following methods. Firstly, C cross section of the wire rod is etched with picral solution so as to appear the pearlite. Next, in the observation with FE-SEM, photographs are taken on the 8 positions with central angle 45° intervals of the C cross section at a magnification of 10000 times in the first surface portion. Thereafter, the lamellar spacing in each colony is obtained based on the number of lamellar which perpendicularly intersect with a segment of 2 μm in each colony where lamellar are oriented in the same direction. Therefore, the area ratio of a region where a lamellar spacing of the pearlite is 150 nm or less can be obtained by an image analysis in an observation visual field.

When the average Vickers hardness at a position of 30 μm in the depth from the surface of the high carbon steel wire rod is lower than HV 280, there is a case where the frequency of disconnection during wire drawing is increased. Therefore, the lower limit of a surface hardness, that is, the lower limit of Vickers hardness at the position is preferably set to HV 280. On the other hand, when the Vickers hardness is more than HV 330, drawability is deteriorated due to die wear. Therefore, the upper limit of the Vickers hardness at the position is preferably set to HV 330.

In addition, the above surface hardness, that is, Vickers hardness is measured at the 8 positions located in 30 μm in the depth from a surface or the C cross section of the wire rod with central angle 45° intervals using micro Vickers hardness meter.

When a tensile strength of the wire rod is more than 760×Ceq.+325 MPa, deformation resistance become higher during wire drawing. As a result, the drawability of the wire rod is deteriorated. Hereinafter, Ceq. can be obtained by the following equation (1). In addition, when a standard deviation of the tensile strength is more than 20 MPa, the frequency of disconnection during wire drawing increases.

$$Ceq.=C\,[\%]+Si\,[\%]/24+Mn\,[\%]/6 \qquad \text{Equation (1)}$$

A tensile test is performed according to JIS Z 2241 in order to measure the tensile strength of the wire rod. Sixteen of 9B specimens are continuously collected from the wire rod along with a longitudinal direction of the wire rod and the tensile strength is obtained. Then, the tensile strength of the wire rod is evaluated by averaging these measured values.

A standard deviation of the tensile strength is obtained based on sixteen of measured data.

Next, a method for producing a high carbon steel wire rod according to an embodiment of the present invention will be described.

In an embodiment of the present invention, a billet having above described chemical components are heated to 950° C. to 1130° C., the billet is hot-rolled so as to obtain a wire rod after heating, the wire rod is coiled at 700° C. to 900° C., primary cooling is performed to the wire rod to 630° C. to 660° C. at a primary cooling rate of 15° C./sec to 40° C./sec after coiling, the wire rod is held in a temperature range of 660° C. to 630° C. for 15 seconds to 70 seconds, and secondary cooling is performed to the wire rod to 25° C. to 300° C. at a secondary cooling rate of 5° C./sec to 30° C./sec. A high carbon steel wire rod according to an embodiment of the present invention can be manufactured by the above described methods. In addition, a difference of the primary cooling rate between the maximum primary cooling rate portion, that is, the primary cooling rate at a position where the primary cooling rate is maximum in a steel wire ring and the minimum primary cooling rate portion, that is, the primary cooling rate at a position where the primary cooling rate is minimum in the steel wire ring is preferably set to 10° C./sec or less in the primary cooling. By this manufacturing method, re-heating is not needed in the cooling process after wire rolling, and thus, it is possible to inexpensively manufacture a high carbon steel wire rod.

When a heating temperature of the billet is lower than 950° C., deformation resistance is raised during hot-rolling and the productivity is deteriorated. On the other hand, when the heating temperature of the billet is higher than 1130° C., there is a case where the average block size of pearlite becomes larger or the area ratio of non-pearlite structures in the second surface portion is higher due to decarburization. Therefore, the drawability is deteriorated.

When a coiling temperature is lower than 700° C., it is difficult to exfoliate scales during mechanical descaling. On the other hand, when the coiling temperature is higher than 900° C., the average block size of pearlite becomes larger, and thus, the drawability is deteriorated.

When a primary cooling rate is slower than 15° C./sec, an average block size of pearlite is larger than 35 μm. On the other hand, when the primary cooling rate is faster than 40° C./sec, it is difficult to control a temperature due to supercooling, and thus, the strengths of the wire rods are not easy to be uniform.

When a holding temperature is higher than 660° C., the average block size of pearlite increases, and thus, the drawability is deteriorated. On the other hand, when the holding temperature is lower than 630° C., the strength of the wire rod is raised, and thus, the drawability is deteriorated. In addition, when a holding time is shorter than 15 seconds, the area ratio of a region where a lamellar spacing of the pearlite is 150 nm or less is more than 20%. On the other hand, when a holding time is longer than 70 seconds, an effect, which is obtained by holding, is saturated.

When a secondary cooling rate is slower than 5° C./sec, it is difficult to exfoliate scales during mechanical descaling. On the other hand, when a secondary cooling rate is faster than 30° C./sec, an effect obtained by secondary cooling is saturated.

In addition, when a difference of the primary cooling rate between at a position where the primary cooling rate is maximum and at a position where the primary cooling rate is minimum is more than 10° C./sec in the primary cooling, there is a case where the strengths of the wire rods are ununiform, and thus, it is not preferable.

EXAMPLES

Next, the technical content of the present invention will be described with reference to examples of the present invention. However, conditions in the examples are simply examples of conditions adopted to confirm feasibility and effects of the present invention, and the present invention is not limited to the examples of the conditions. The present invention can adopt a variety of conditions within the scope of the present invention as long as the objects of the present invention can be achieved.

Example 1

After billets having chemical components shown in Table 1 were heated, the billets were hot-rolled to obtain wire rods having a diameter of 5.5 mm, the wire rods were coiled at a prescribed temperature and the wire rods were cooled by Stelmor equipment.

Using the cooled wire rods, textures of C cross section of the wire rods were observed and the tensile test was performed. After scales of the obtained wire rods were exfoliated by pickling, ten of wire rods having a length of 4 m to which zinc phosphate coating were given by bonderizing were prepared. Then, using a die having an approach angle of 10°, wire drawing with mono block type was performed at a reduction of 16% to 20% per one pass. Finally, the average value of the true strain at a braking point during drawing was obtained.

Manufacturing conditions, structures and mechanical properties are shown in Table 2. "Holding Time" in the Table 2 shows a holding time in a temperature range of 660° C. to 630° C. The required technical features of the present invention did not accomplish the goal in the comparative examples Nos. 2, 4, 6, 11, 14 and 16 in the Table 2. In the comparative examples Nos. 2, 11 and 14, an area ratio of a region where a lamellar spacing of the pearlite is 150 nm or less were more than 20% in the first surface portion. In addition, tensile strengths were not within a preferable range of the present invention in these comparative examples. Compared with examples Nos. 1, 10 and 13 which were examples of the present invention using the same steel, values of strain at a braking point during drawing were lower in these comparative examples. In addition, average block sizes of the pearlite were over the upper limit of the present invention and area ratios of the pearlite having a block size of 50 μm or more was more than 20% in the comparative examples Nos. 4 and 16. Compared with examples Nos. 3 and 15 which were examples of the present invention using the same steel, values of strain at a braking point during drawing were lower in these comparative examples. In addition, a standard deviation of the tensile strength of the comparative example No. 6 was over the preferable range of the present invention. Compared with example No. 5 which was example of the present invention using the same steel, value of strain at a braking point during drawing was lower in this comparative example.

[Table 1]

[Table 2]

Example 2

After billets having chemical components shown in Table 3 were heated, the billets were hot-rolled to obtain wire rods having a diameter of 5.5 mm, the wire rods were coiled at a prescribed temperature and the wire rods were cooled by Stelmor equipment.

Using the cooled wire rods, structures of C cross section of the wire rods were observed and the tensile test was performed. After scales of the obtained wire rods were exfoliated by pickling, ten of wire rods having a length of 4 m to which zinc phosphate coating were given by bonderizing were prepared. Then, using a die having an approach angle of 10°, wire drawing with mono block type was performed at a reduction of 16% to 20% per one pass. Finally, the average value of the true strain at a braking point during drawing was obtained.

Manufacturing conditions, structures and mechanical properties are shown in Table 4. "Holding Time" in the Table 4 shows a holding time in a temperature range of 660° C. to 630° C. The area ratio of pearlite in the second surface portion is an area ratio of pearlite in a region within a range of 30 μm or less in the depth from the surface of the wire rod. Vickers hardness at the second portion is Vickers hardness at a position of 30 μm in the depth from the surface of the wire rod. The preferable technical features of the present invention did not accomplish the goal in the comparative examples Nos. 19, 22, 24, 26, 30 and 32. In the comparative examples Nos. 19, 22, 26 and 30, the area ratio of the pearlite in the second surface portion were over the preferable range of the present invention. Furthermore, in the comparative examples Nos. 19, 22, 26 and 30, average Vickers hardness at the second surface portion was lower than the preferable range of the present invention. Compared with examples Nos. 18, 21, 25 and 12 which were examples of the present invention using the same steel, values of strain at a braking point during drawing were lower in comparative examples. In addition, the average Vickers hardness at the second surface portion was lower than the preferable range of the present invention in the comparative example No. 29. Compared with example No. 31 which was example of the present invention using the same steel, value of strain at a braking point during drawing was lower in this comparative example. In addition, a standard deviation of the tensile strength of the comparative example No. 24 was over the preferable range of the present invention. Compared with example No. 23 which was example of the present invention using the same steel, value of strain at a braking point during drawing was lower in this comparative example.

[Table 3]

[Table 4]

INDUSTRIAL APPLICABILITY

According to the above-described aspects of the present invention, it is possible to inexpensively provide a high carbon steel wire rod having an excellent drawability which is suitable for a steel cord and a sawing wire and a method for manufacturing the same under high productivity with good yield. Therefore, the present invention is enough to have the industrial applicability in the wire manufacturing industry.

BRIEF DESCRIPTION OF THE REFERENCE SYMBOLS

1: Second surface portion
2: First surface portion
3: ½D portion
4: ¼D portion

TABLE 1

| STEEL | G | Si | Mn | P | S | Al | N | B | Cr | Ni | V | Cu | Mo | Nb |
|---|---|---|---|---|---|---|---|---|---|---|---|---|---|---|
| | | | | | | | | | | | | | (MASS %) | |
| A | 0.68 | 0.19 | 0.82 | 0.010 | 0.009 | 0.002 | 0.0042 | 0.0007 | | | | | | |
| B | 0.72 | 0.20 | 0.49 | 0.008 | 0.009 | 0.001 | 0.0026 | | | | | | | |
| C | 0.72 | 0.19 | 0.50 | 0.009 | 0.008 | 0.001 | 0.0034 | | 0.12 | | | | | |
| D | 0.73 | 0.21 | 0.48 | 0.008 | 0.009 | 0.001 | 0.0029 | | | 0.11 | | | | |
| E | 0.77 | 0.20 | 0.51 | 0.009 | 0.008 | 0.002 | 0.0031 | | | | | | | 0.06 |
| F | 0.82 | 1.21 | 0.50 | 0.008 | 0.009 | 0.001 | 0.0028 | | | | | | 0.13 | |
| G | 0.82 | 0.19 | 0.50 | 0.008 | 0.009 | 0.001 | 0.0033 | | | | | | | |
| H | 0.92 | 0.18 | 0.51 | 0.009 | 0.006 | 0.001 | 0.0024 | | | | | | | |
| I | 0.92 | 0.18 | 0.50 | 0.007 | 0.008 | 0.001 | 0.0029 | | | | | 0.12 | | |
| J | 1.02 | 0.19 | 0.49 | 0.008 | 0.009 | 0.002 | 0.0032 | | | | 0.07 | | | |
| K | 1.12 | 0.20 | 0.49 | 0.007 | 0.008 | 0.001 | 0.0029 | | | | | | | |

TABLE 2

| NO. | STEEL | HEATING TEMPERATURE (° C.) | COILING TEMPERATURE (° C.) | PRIMARY COOLING RATE (° C./s) | HOLDING TIME (s) | SECONDARY COOLING RATE (° C./s) | AREA RATIO OF PEARLITE (%) | AVERAGE BLOCK SIZE OF PEARLITE (μm) | AREA RATIO OF PEARLITE HAVING BLOCK SIZE OF 50 μM OR MORE (%) |
|---|---|---|---|---|---|---|---|---|---|
| 1 | A | 1050 | 900 | 16 | 16 | 15 | 95 | 19 | 3.3 |
| 2 | A | 1050 | 880 | 13 | 7 | 13 | 95 | 16 | 1.9 |
| 3 | B | 1110 | 820 | 23 | 23 | 16 | 96 | 26 | 6.7 |
| 4 | B | 1110 | 880 | 8 | 40 | 8 | 98 | 43 | 38 |
| 5 | C | 1010 | 870 | 19 | 25 | 14 | 96 | 25 | 8.9 |
| 6 | C | 1010 | 750 | 14 | 40 | 15 | 97 | 27 | 12 |
| 7 | D | 1090 | 740 | 26 | 24 | 13 | 97 | 27 | 9.4 |
| 8 | E | 1040 | 860 | 19 | 18 | 16 | 97 | 28 | 7.6 |
| 9 | F | 1090 | 880 | 17 | 22 | 15 | 98 | 22 | 7.1 |
| 10 | G | 1060 | 870 | 18 | 22 | 13 | 96 | 26 | 8.5 |
| 11 | G | 1060 | 880 | 15 | 8 | 18 | 97 | 21 | 2.4 |
| 12 | H | 1020 | 890 | 16 | 29 | 16 | 98 | 23 | 9.4 |
| 13 | I | 1090 | 760 | 22 | 26 | 18 | 98 | 18 | 2.2 |
| 14 | I | 1090 | 870 | 15 | 8 | 18 | 99 | 15 | 0.9 |
| 15 | J | 1120 | 850 | 19 | 18 | 21 | 98 | 24 | 8.4 |
| 16 | J | 1120 | 870 | 9 | 42 | 9 | 99 | 45 | 41 |
| 17 | K | 1130 | 870 | 15 | 19 | 14 | 99 | 32 | 15 |

| NO. | AREA RATIO OF REGION WHERE LAMELLAR SPACING OF THE PEARLITE IS 150 nm OR MORE (%) | UPPER LIMIT OF TENSILE STRENGTH 760 × Ceq. + 325 (MPa) | TENSILE STRENGTH (MPa) | STANDARD DEVIATION OF TENSILE STRENGTH (MPa) | AVERAGE VALUE OF TRUE STRAIN AT BRAKING POINT DURING DRAWING | REMARKS |
|---|---|---|---|---|---|---|
| 1 | 18 | 952 | 920 | 13 | 4.2 | EXAMPLE |
| 2 | 45 | 952 | 1063 | 16 | 3.7 | COMPARATIVE EXAMPLE |
| 3 | 13 | 941 | 913 | 11 | 4.4 | EXAMPLE |
| 4 | 6 | 941 | 904 | 28 | 3.7 | COMPARATIVE EXAMPLE |
| 5 | 15 | 942 | 911 | 14 | 4.4 | EXAMPLE |
| 6 | 15 | 942 | 904 | 38 | 3.7 | COMPARATIVE EXAMPLE |
| 7 | 14 | 947 | 921 | 15 | 4.2 | EXAMPLE |
| 8 | 16 | 981 | 952 | 8 | 4.0 | EXAMPLE |
| 9 | 12 | 1050 | 1021 | 13 | 4.0 | EXAMPLE |
| 10 | 13 | 1018 | 989 | 15 | 4.2 | EXAMPLE |
| 11 | 55 | 1018 | 1112 | 18 | 3.5 | COMPARATIVE EXAMPLE |

TABLE 2-continued

| | | | | | | |
|---|---|---|---|---|---|---|
| 12 | 8 | 1095 | 1065 | 9 | 3.7 | EXAMPLE |
| 13 | 7 | 1093 | 1073 | 11 | 3.7 | EXAMPLE |
| 14 | 72 | 1093 | 1204 | 17 | 3.2 | COMPARATIVE EXAMPLE |
| 15 | 10 | 1168 | 1139 | 16 | 3.7 | EXAMPLE |
| 16 | 7 | 1168 | 1102 | 31 | 3.2 | COMPARATIVE EXAMPLE |
| 17 | 6 | 1245 | 1219 | 12 | 3.4 | EXAMPLE |

TABLE 3

| STEEL | C | Si | Mn | P | S | Al | N | B | Cr | Ni | V | Cu | Mo | Nb |
|---|---|---|---|---|---|---|---|---|---|---|---|---|---|---|
| | | | | | | | | | | | | | (MASS %) | |
| A2 | 0.72 | 0.19 | 0.51 | 0.008 | 0.008 | 0.001 | 0.0029 | | | 0.12 | | | | |
| B2 | 0.72 | 0.20 | 0.49 | 0.008 | 0.009 | 0.001 | 0.0027 | | 0.11 | | | | | |
| C2 | 0.72 | 1.19 | 0.49 | 0.007 | 0.008 | 0.001 | 0.0030 | | | | | | | |
| D2 | 0.77 | 0.18 | 0.51 | 0.008 | 0.009 | 0.002 | 0.0034 | | | | | 0.11 | | |
| E2 | 0.82 | 0.22 | 0.49 | 0.007 | 0.009 | 0.001 | 0.0027 | | | | | | 0.12 | |
| F2 | 0.82 | 0.18 | 0.48 | 0.008 | 0.008 | 0.001 | 0.0026 | | | | | | | |
| G2 | 0.92 | 0.19 | 0.48 | 0.008 | 0.009 | 0.002 | 0.0031 | | | | | | | 0.06 |
| H2 | 0.92 | 0.18 | 0.49 | 0.009 | 0.009 | 0.001 | 0.0036 | 0.0005 | | | | | | |
| I2 | 1.02 | 0.19 | 0.49 | 0.008 | 0.008 | 0.001 | 0.0029 | | | | 0.07 | | | |

TABLE 4

| NO. | STEEL | HEATING TEMPERATURE (° C.) | COILING TEMPERATURE (° C.) | PRIMARY COOLING RATE (° C./s) | HOLDING TIME (s) | SECONDARY COOLING RATE (° C./s) | AREA RATIO OF PEARLITE AT SECOND SURFACE PORTION (%) |
|---|---|---|---|---|---|---|---|
| 18 | A2 | 1030 | 890 | 16 | 17 | 10 | 91 |
| 19 | A2 | 1250 | 950 | 15 | 17 | 8 | 77 |
| 20 | B2 | 1050 | 870 | 18 | 22 | 11 | 93 |
| 21 | C2 | 1060 | 830 | 20 | 20 | 8 | 90 |
| 22 | C2 | 1230 | 910 | 19 | 19 | 10 | 81 |
| 23 | D2 | 1040 | 850 | 18 | 18 | 9 | 93 |
| 24 | D2 | 1040 | 850 | 20 | 8 | 22 | 95 |
| 25 | E2 | 1010 | 750 | 16 | 20 | 15 | 95 |
| 26 | E2 | 1010 | 720 | 3 | 40 | 8 | 71 |
| 27 | F2 | 990 | 870 | 17 | 23 | 12 | 92 |
| 28 | G2 | 1000 | 740 | 25 | 22 | 10 | 93 |
| 29 | H2 | 1010 | 790 | 16 | 20 | 10 | 95 |
| 30 | H2 | 1030 | 720 | 3 | 42 | 9 | 88 |
| 31 | I2 | 1040 | 820 | 16 | 21 | 11 | 94 |
| 32 | I2 | 1250 | 920 | 16 | 22 | 10 | 90 |

| NO. | VICKERS HARDNESS AT SECOND SURFACE PORTION (HV) | UPPER LIMIT OF TENSILE STRENGTH 760 × Ceq. + 325 (MPa) | TENSILE STRENGTH (MPa) | AVERAGE VALUE OF TRUE STRAIN AT BRAKING POINT DURING DRAWING | REMARKS |
|---|---|---|---|---|---|
| 18 | 297 | 943 | 924 | 4.4 | EXAMPLE |
| 19 | 240 | 943 | 915 | 3.7 | COMPARATIVE EXAMPLE |
| 20 | 305 | 941 | 925 | 4.4 | EXAMPLE |
| 21 | 304 | 972 | 953 | 4.2 | EXAMPLE |
| 22 | 259 | 972 | 942 | 3.7 | COMPARATIVE EXAMPLE |
| 23 | 298 | 981 | 966 | 4.2 | EXAMPLE |
| 24 | 301 | 981 | 1021 | 3.9 | COMPARATIVE EXAMPLE |
| 25 | 314 | 1017 | 990 | 4.0 | EXAMPLE |
| 26 | 249 | 1017 | 992 | 3.5 | COMPARATIVE EXAMPLE |
| 27 | 299 | 1015 | 983 | 4.0 | EXAMPLE |
| 28 | 308 | 1091 | 1074 | 3.8 | EXAMPLE |
| 29 | 315 | 1092 | 1069 | 3.8 | EXAMPLE |
| 30 | 265 | 1092 | 1066 | 3.4 | COMPARATIVE EXAMPLE |
| 31 | 305 | 1168 | 1140 | 3.5 | EXAMPLE |
| 32 | 277 | 1168 | 1136 | 3.1 | COMPARATIVE EXAMPLE |

What is claimed is:

1. A steel wire rod comprising, as chemical components, by mass %:

C: 0.60% to 1.20%;

Si: 0.10% to 1.5%;

Mn: 0.10% to 1.0%;

P: 0.001% to 0.012%;

S: 0.001% to 0.010%;

Al: 0.0001% to 0.010%;

N: 0.0010% to 0.0050%; and a remainder including Fe and impurities, wherein an area ratio of pearlite is 95% or more and a remainder is a non-pearlite structure which includes one or more of a bainite, a degenerate pearlite, a proeutectoid ferrite and a proeutectoid cementite in a cross section perpendicular to a longitudinal direction;

wherein an average block size of the pearlite is 15 μto 35 μm and an area ratio of the pearlite having a block size of 50 μm or more is 20% or less;

wherein an area ratio of a region where a lamellar spacing of the pearlite is 150 nm or less is 20% or less in a region within a depth from a surface of the steel wire rod of 1 mm or less; and wherein when C [%], Si [%] and Mn [%] represent an amount of C, an amount of Si and an amount of Mn respectively in a following equation (1) and a Ceq. is calculated by the following equation (1), a tensile strength of the steel wire rod is 760×Ceq.+325 MPa or less and a standard deviation of the tensile strength is 20 MPa or less, $$Ceq.=C\,[\%]+Si\,[\%]/24+Mn\,[\%]/6 \qquad \text{Equation (1).}$$

2. The steel wire rod according to claim 1, wherein the steel wire rod includes, as a chemical component, by mass %: C: 0. 70% to 1.10%, wherein the area ratio of the pearlite in a region within a depth from the surface of the steel wire rod of 30 μm or less is 90% or more and a remainder is the non-pearlite structure which includes one or more of the bainite, the degenerate pearlite and the proeutectoid cementite, and wherein an average Vickers hardness at a position of 30 μm in the depth from the surface of the steel wire rod is HV 280 to HV 330.

3. The steel wire rod according to claim 2, wherein the steel wire rod includes, as a chemical component, by mass %: one or more kinds selected from the group consisting of B:0.0001% to 0.0015%; Cr: 0.10% to 0.50%; Ni: 0.10% to 0.50%; V: 0.05% to 0.50%; Cu: 0.10% to 0.20%; Mo: 0.10% to 0.20% and Nb: 0.05% to 0.10%.

4. The steel wire rod according to claim 1, wherein the steel wire rod includes, as a chemical component, by mass %: one or more kinds selected from the group consisting of B: 0.0001% to 0.0015%; Cr: 0.10% to 0.50%; Ni: 0.10% to 0.50%; V: 0.05% to 0.50%; Cu: 0.10% to 0.20%; Mo: 0.10% to 0.20% and Nb: 0.05% to 0.10%.

5. A method for manufacturing a steel wire rod according to Claim 1, the method comprising:

heating a billet to 950° C. to 1130° C., wherein the billet includes, as a chemical component, by mass %: C: 0.60% to 1.20%, Si: 0.1% to 1.5%, Mn: 0.1% to 1.0%, P: 0.001% to 0.012%, S: 0.001% to 0.010%, Al: 0.0001% to 0.010% and N: 0.0010% to 0.0050%, and a remainder including Fe and impurities, and hot-rolling the billet so as to obtain a wire rod after heating; coiling the wire rod at 700° C. to 900° C.;

primary cooling the wire rod to 630° C. to 660° C. at a primary cooling rate of 15° C./sec to 40° C./sec;

holding the wire rod at 660° C. to 630° C. for 15 seconds to 70 seconds; and secondary cooling the wire rod to 25° C. to 300° C. at a secondary cooling rate of 5° C/sec to 30° C./sec, wherein the wire rod of claim 1 is produced.

6. The method for manufacturing a steel wire rod according to claim 5, wherein a difference of the primary cooling rate between at a position where the primary cooling rate is maximum in a steel wire ring and at a position where the primary cooling rate is minimum in the steel wire ring is 10° C./sec or less in the primary cooling.

7. The steel wire rod according to claim 1, wherein the steel wire rod includes, as a chemical component, by mass %:

C: 0.77% to 1.20%.

* * * * *